US006848281B2

(12) United States Patent
Ishihara et al.

(10) Patent No.: US 6,848,281 B2
(45) Date of Patent: Feb. 1, 2005

(54) STRETCHABLE WARP KNITTED FABRIC

(75) Inventors: Mitsutoshi Ishihara, Toyama-ken (JP); Toshiaki Takizawa, Toyama-ken (JP); Eiji Nakayama, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/429,750

(22) Filed: May 6, 2003

(65) Prior Publication Data

US 2003/0211798 A1 Nov. 13, 2003

(30) Foreign Application Priority Data

May 8, 2002 (JP) ..... 2002-132214

(51) Int. Cl.[7] ..... D04B 21/16
(52) U.S. Cl. ..... 66/195
(58) Field of Search ..... 66/190–196; 442/312–314, 442/304–306

(56) References Cited

U.S. PATENT DOCUMENTS 3,314,251 A * 4/1967 Bunger ..... 66/193
3,845,641 A * 11/1974 Waller ..... 66/192
4,244,199 A 1/1981 Rhode
4,818,316 A * 4/1989 Weinle et al. ..... 66/193
5,125,246 A 6/1992 Shytles
5,512,354 A * 4/1996 Scholz et al. ..... 442/306
5,540,982 A * 7/1996 Scholz et al. ..... 442/59

FOREIGN PATENT DOCUMENTS

WO WO 94/17229 8/1994
WO WO 97/38658 10/1997

OTHER PUBLICATIONS

European Patent Office Search Report dated Aug. 7, 2003 for Application EP 03 00 9331.

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

A stretchable warp knitted fabric comprising warp knitting yarns, first weft in-laid yarns and second weft in-laid yarns, and stretchable warp in-laid yarns. The second weft in-laid yarns consist of a plurality of at least non-stretchable yarns, and said second weft in-laid yarns run sequentially and separately in the course direction on different wale regions of the same course with having an arbitrary length respectively, while crossing the first weft in-laid yarns between courses. Consequently, even when pulled in a longitudinal direction, because the separate second weft in-laid yarns influence each other independently, the fabric does not have a great amount of ruffling in a width direction thereof and thus the a flat surface is maintained wherein there is no narrowing in the middle of the longitudinal direction.

6 Claims, 5 Drawing Sheets

STRETCHABLE WARP KNITTED FABRIC

BACKGROUND OF THE INVENTION

1. Field of the Invention

The present invention relates to a stretchable warp knitted fabric which stretches in a wale direction, and more particularly, to a stretchable warp knitted fabric with excellent flexibility, in which stretching in a course direction is minimized when it is extended in the wale direction, and thus ruffling does not occur.

2. Description of the Related Art

Fabrics which are adhered to a body such as a fastening band, a bracing band, or a supporter are required to be extensible in at least a longitudinal direction thereof such that they can deform in accordance with any given body shape.

As such a stretchable fabric, it is preferably to use a fabric obtained by knitting. A structure of the knitted fabric is less compact than that of a fabric obtained by weaving, and there is a space in a knitted loop itself as well as between the loops, and at the same time by interposing a stretchable yarn in the fabric, the fabric can have suitable and stable stretch properties over a long period of time. Particularly, because a weft knitted fabric can stretch in warp and weft (wale and course) directions, it is often used as the stretchable fabric.

However, there is a tendency for the weft knitted fabric to be too flexible when compared with the woven fabric. Meanwhile, a warp knitted fabric is more flexible than the woven fabric, and it is stretchable to some extent due to its characteristic knitted loops structure.

However, when this stretchable warp knitted fabric is pulled in the longitudinal direction, a width thereof shrinks and becomes narrow in the middle thereof. In order to avoid such a condition, in JP-A No. 2000-509109, a single monofilament is run through substantially the entire width of the fabric in the course direction, thereby making the configuration of the fabric stable.

However, in the case where one monofilament is run through an entire surface of the fabric along the courses of the warp knitted fabric as a weft in-laid yarn, when the fabric is pulled in the longitudinal direction, the monofilament itself deforms in a ruffled state and then, a great amount ruffling of the fabric is provided in a width direction.

An object of the invention is to provide a flexible warp knitted fabric, in which a great amount of ruffling in the width direction does not occur and there is no narrowing in the middle of the longitudinal direction, even when pulled in the longitudinal direction.

SUMMARY OF THE INVENTION

The above-mentioned object is achieved by a basic structure of the invention, that is, by a stretchable warp knitted fabric having warp knitting yarns which form wales, weft in-laid yarns which run in a course direction, and stretchable warp in-laid yarns which run in a wale direction, wherein the weft in-laid yarns comprise first weft in-laid yarns which form a ground weave of the fabric and a plurality of second weft in-laid yarns which consist of at least a non-stretchable yarn, and said plurality of second weft in-laid yarns run sequentially in the course direction on different wale regions of the same course with having an arbitrary length respectively, while crossing the first weft in-laid yarns between courses.

That is to say, the stretchable warp knitted fabric according to the invention has basic structural yarns including:

warp knitting yarns which form the wales; weft in-laid yarns that connect the respective warp knitting yarns and are inserted in the course direction; and stretchable warp in-laid yarns arranged in each wale and inserted in a wale direction, and further comprising a plurality of weft in-laid yarns that consist of at least non-stretchable yarns and are inserted in the course direction in different wale regions on the same course. The weft in-laid yarns that connect the respective warp knitting yarns and are inserted in the course direction are called first weft in-laid yarns, and the plurality of weft in-laid yarns that are inserted in the course direction in the different predetermined wale regions on the same course are called second weft in-laid yarns.

The first weft in-laid yarns are regular weft in-laid yarns for use in warp knitted fabrics. They sometimes runs along the entire width of the fabric, but usually a plurality of weft in-laid yarns which are disposed so as to be adjacent in the wale direction are swung back to the adjacent course every groups of 3 to 5 wales, and this is repeated in the course direction to cover the entire width of the fabric. Meanwhile, the second weft in-laid yarns of the invention are knitting yarns which is inserted in the course direction separately from the first weft in-laid yarns, and a plurality of second weft in-laid yarns, in the same manner as the first weft in-laid yarns, are made adjacent to each other in the course direction, and they are inserted in the course direction so as to stride over some wales respectively, and then swung back to the adjacent course. This movement is repeated so as to cover the entire fabric. At this time, each of the second weft in-laid yarns is run so as to cross the first weft in-laid yarn between the courses.

A synthetic fiber yarn such as multifilament or monofilament, as well as a spun yarn such a raw silk yarn, a cotton yarn, or a wool yarn may be used as the first weft in-laid yarn. Also, a non-stretchable yarn like a synthetic fiber yarn or a spun yarn may also be used as the second weft in-laid yarn, like the first weft in-laid yarn, but the synthetic fiber yarn must be monofilament for the second weft in-laid yarn. In addition, even if the second weft in-laid yarn is the monofilament or the spun yarn, its must be thicker and more rigid than the first weft in-laid yarn.

Due to this configuration, the second weft in-laid yarns which are inserted such that the fabric is divided into one or more regions in the width direction of the fabric connect the wales in the respective regions, and this stabilizes the knitting structure in each of the regions. In addition, when the stretchable warp knitted fabric is pulled in the wale direction (longitudinal direction), in the plurality of weft in-laid yarns which separate the fabric into regions in the course direction, the force which attempts to cause shrinking due to pulling in the wale direction is dispersed to each of the second weft in-laid yarns, and even if there is an attempt to ruffle in each of the regions, this is blocked by the adjacent weft in-laid yarns, and there is no significant amount of ruffling. As a result, the entire stretchable warp knitted fabric also has no narrowing in the width direction, and thus an extremely stable flat configuration can be maintained.

In the invention, it is preferable that portions of return ends of the second weft in-laid yarns, which run beside each other and between adjacent courses, are entwined with the knitted loops on the same wale. Because each of the return ends of the second weft in-laid yarns which are next to each other and between adjacent courses, is entwined with the knitted loops on the same wale, even when the stretchable warp knitted fabric is pulled in the wale direction (longitudinal direction), if the stretchable warp knitted fabric attempts to contract in the width direction, the return ends of the second weft in-laid yarns which are adjacent in the course direction cancel the forces which attempt to contract each other, and the stretchable warp knitted fabric has no narrowing in the width direction thereof and a more stable flat surface configuration can be maintained.

Further, it is preferable in the invention that portions of the return ends of the second weft in-laid yarns, which run beside each other and between adjacent courses, are entwined with knitted loops of adjacent wales on an adjacent course, respectively. Because the return ends of the weft in-laid yarns are on the same wale, in the configuration described above, two weft in-laid yarns are entwined in the adjacent knitted loops of that wale. Thus at the same wale, the fabric has a linear rise in the wale direction, and the whole fabric has a linear pattern extending in the wale direction. To the contrary, because the return ends of the respective weft in-laid yarns which run beside each other on adjacent courses are on adjacent wales, and not on the same wale, there are none of the above-described patterns which extend linearly, and also, the flexibility of the stretchable warp knitted fabric in the width direction is improved.

Furthermore, it is preferable that portions of running regions for the second weft in-laid yarns which run in the adjacent courses share a wale region. The return ends of the plurality of weft in-laid yarns are not respectively entwined between the knitted loops on the same wale, but rather entwined between the loops on different wales. Thus, all of the return ends between the courses of the same weft in-laid yarn are not in the same wale, but dispersed on a plurality of wales. Therefore, the above-described linear pattern does not occur, and also return ends of the plurality of second weft in-laid yarns are dispersed in a plurality of wale regions. Accordingly, even if the stretchable warp knitted fabric is pulled in the longitudinal direction thereof, the stretchable warp knitted fabric has no narrowing in the width direction, there is no local pattern, and an even more stable flat surface configuration can be maintained.

Further, in addition to the above-mentioned structure, the stretchable warp knitted fabric further comprises pile knitting yarns, wherein the pile knitting yarns form pile loops which stand from the knitted fabric surface. This pile knitting yarn comprises a monofilament yarn and/or a multifilament yarn. The monofilament yarn is later cut at a portion of the pile loop made to be a hook piece which is a male engaging element of a surface fastener. In the multifilament yarn, buffing is carried out for the pile loop and the yarn can made to be a loop piece which is a female engaging element of the surface fastener.

It is also preferable that the pile knitting yarns cross over adjacent wales for at least every 3 courses and forms the pile loops. Because the pile loops are formed in the wale direction and the course direction with a required angle, when they are made to be engaging elements of the surface surface, engaging direction is inclined and the engagement rate of the engaging elements of the surface fastener is increased and accordingly the stripping strength is increased.

DESCRIPTION OF THE PREFERRED EMBODIMENTS

Preferred embodiments of the invention will be described in detail with reference to the drawings.

Figure 1:
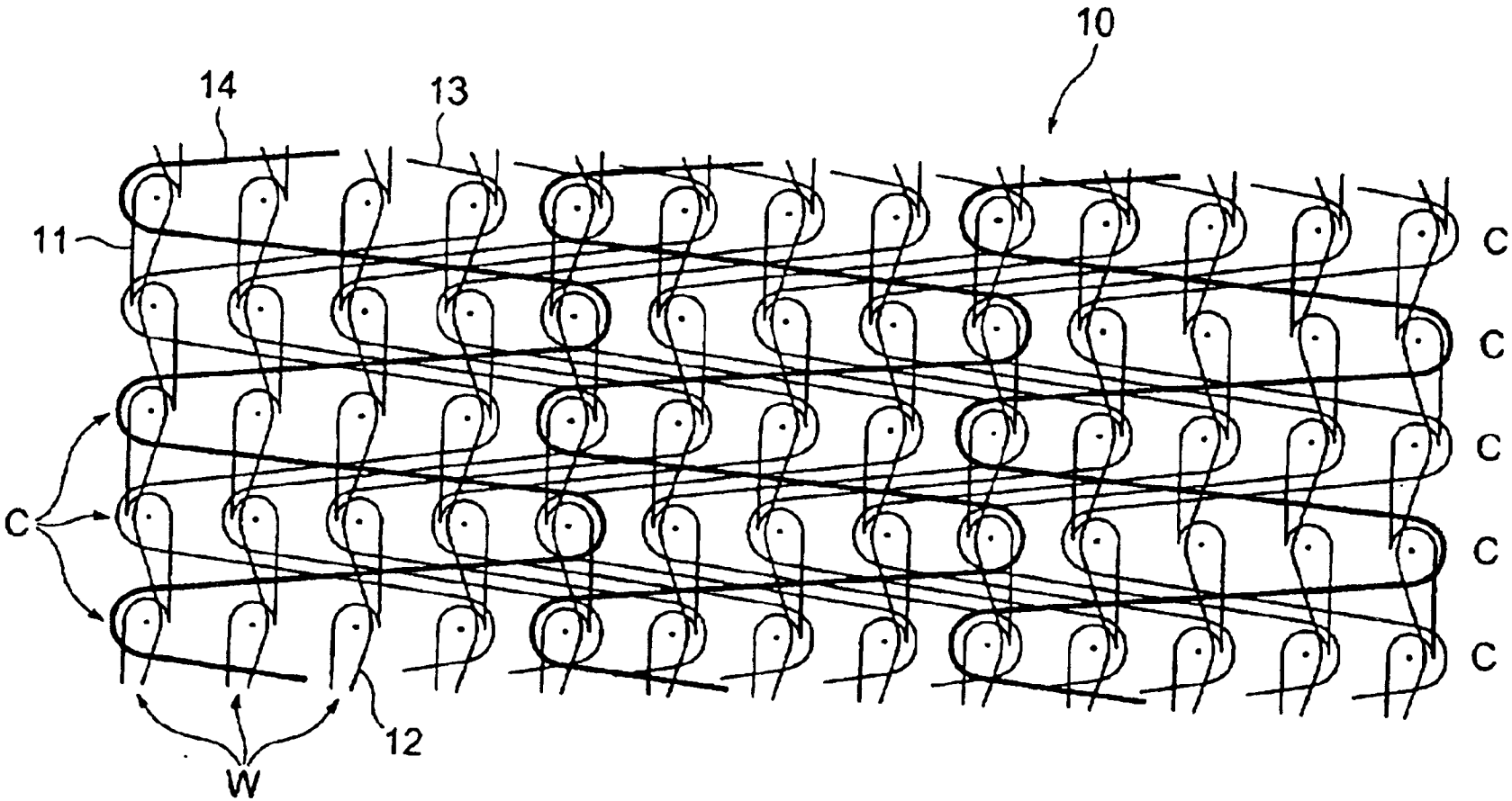
FIG. 1 is a partial plan view shows a structure of a stretchable warp knitted fabric according to a first embodiment of the invention.

FIG. 1 schematically shows a part of a knitting structure of a stretchable warp knitted fabric according to a first embodiment of the invention. It is to be noted that in FIG. 1, the illustrated structure is repeatedly disposed from the left to the right sides so as to have a predetermined knitting width, and the illustrated structure is disposed repeatedly in the vertical direction with respect to the page surface until a desired length is obtained. Also, in the figure, a space between wales W and a space between courses, as well as a thickness of knitting yarns are shown so as to be exaggerated, but in an actual fabric, there are little or no such spaces and they are arranged to be very close. The thickness of the knitting yarns for use in each structure should not be influenced by their appearance in the figure, but rather should be suitably selected.

In a stretchable warp knitted fabric 10 according to the embodiment illustrated in FIG. 1, warp knitting yarns that form wales W comprise 0-1/1-0 chain knitting yarns 11, and stretchable weft in-laid yarns 12 are entwined with the chain knitting yarns 11 of each wale W in a zigzag shape and knitted in a wale direction (longitudinal direction of the fabric). Further, in this embodiment, a large number of first weft in-laid yarns 13 having a 0-4/4-4 structure in order to connect chain knitted loop every group of 4 wales, are run sequentially in a course direction while dislocating their return ends by one wale. If one of the first weft in-laid yarns 13 is examined, it is found that its return ends on the same wale W are formed on every other course.

Further, in this embodiment, a plurality of second weft in-laid yarns 14 are weft-inlaid into courses C having no return ends the aforementioned first weft in-laid yarns 13 which are returned every other course in the same wale, while return ends of the second weft in-laid yarns are arranged on the courses. Each of the plurality of second weft in-laid yarns 14 of this embodiment comprises a 0-0/5-5 structure which is returned every 5 wales and runs in the course direction, and the return ends of the second weft in-laid yarns 14 which are adjacent in the course direction are arranged on the same wale W. By inserting the second weft in-laid yarns 14 as described above, the first weft in-laid yarns 13 and the second weft in-laid yarns 14 run so as to cross each other between the same courses.

A processed yarn formed of multifilament is used as the warp knitting yarn 11 of this embodiment, and a regular spandex yarn made of nylon is used as the above-mentioned stretchable warp knitting yarn 12, regular multifilament is used as the first weft in-laid yarn 13, and monofilament is used as the second weft in-laid yarn 14, respectively. Because this type of stretchable warp knitted fabric is characterized by being flexible, it is preferable that the knitting yarn used is also flexible. For this reason, in this invention, it is preferable that except for the second weft in-laid yarn 14, a processed yarn formed of regular multifilament or monofilament is used as the knitting yarn. Meanwhile, in order to ensure stability of the configuration of the fabric when it is stretched, the second weft in-laid yarn 14 must be a yarn that is not stretchable and is rigid to some extent. It is preferable that this yarn is a spun yarn formed of the above-mentioned monofilament, a natural fiber or synthetic fiber.

When the stretchable warp knitted fabric 10 according to the embodiment which has the above-described structure is pulled in the longitudinal direction (wale direction), because the plurality of second weft in-laid yarns 14 formed of monofilament are inserted such that they are separated by a predetermined region in the width direction (course direction) of the fabric 10, and at the same time, the return ends of the respective second weft in-laid yarns 14 adjacent in the width direction of the fabric 10 are returned while being entwined with the knitted loops formed by the warp knitting yarns 11 on the same wale, with respect to the contracting force of the fabric 10 in the width direction thereof, each of the second weft in-laid yarns 14 bears and thus obstructs the contracting of a partial width of the fabric 10 in a state in which each of the second weft in-laid yarns 14 is extended, and also the second weft in-laid yarns 14 adjacent in the width direction pull each other in the width direction and suppresses ruffle deformation of each other. As a result, even when the stretchable warp knitted fabric 10 is pulled, the monofilament itself does not deform into a ruffle, and thus the width of the stretchable warp knitted fabric 10 does not shrink and at the same time it does not twisted, so that a flat surface can be maintained without any changes in the width.

Figure 2:
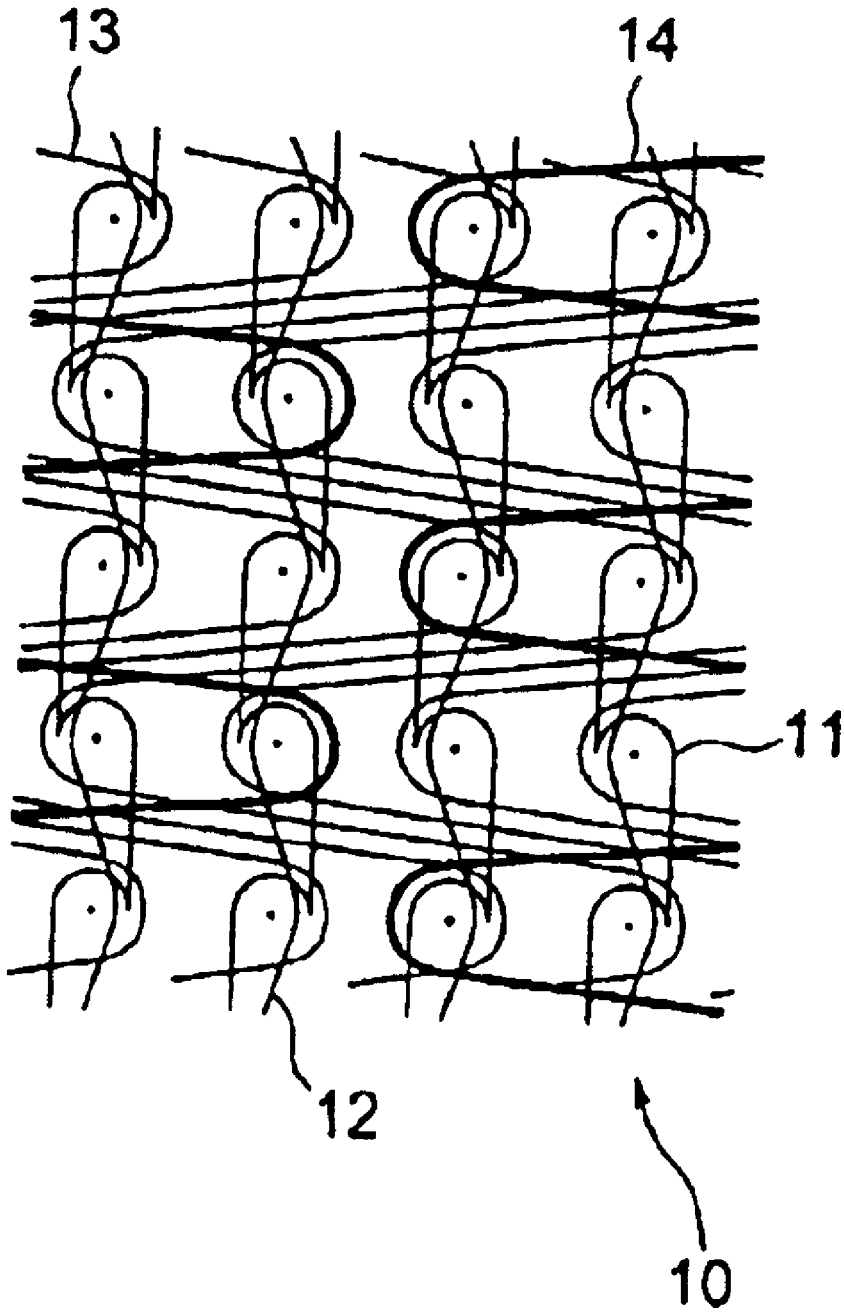
FIG. 2 is a partial plan view showing a structure of a stretchable warp knitted fabric according to a second embodiment of the invention.

FIG. 2 illustrates a knitting structure of a part of a stretchable warp knitted fabric according to a second embodiment of the invention. The knitting structure which is the base of this embodiment is similar to that of the first embodiment, but respective return ends of second weft in-laid yarns 14 adjacent in the course direction with being dislocated between the courses, are not formed on the same wale, but rather on adjacent wales.

Because the embodiment has the configuration described above, a linear swelled portion (pattern), which appears in the above first embodiment due to the respective return ends of the adjacent second weft in-laid yarns 14 being formed in the same wale so as to be dislocated between the courses, does not appear on the surface of the stretchable warp knitted fabric according to this embodiment, and thus the surface of the stretchable warp knitted fabric may be an extremely neat and flat surface. Further, if the respective return ends of the adjacent second weft in-laid yarns 14 are formed on the same wale on the surface of the stretchable warp knitted fabric, there is a tendency for this wale portion to be stiffened. However, according to this embodiment, because the respective return ends of the adjacent second weft in-laid yarns 14 are formed apart from each other by having one wale therebetween, wale regions includes the return ends are not stiffened, and flexibility can be ensured. Alternately, a wale W1 may be formed between the respective return ends of the adjacent second weft in-laid yarns 14, which do have return ends present therein.

Figure 3:
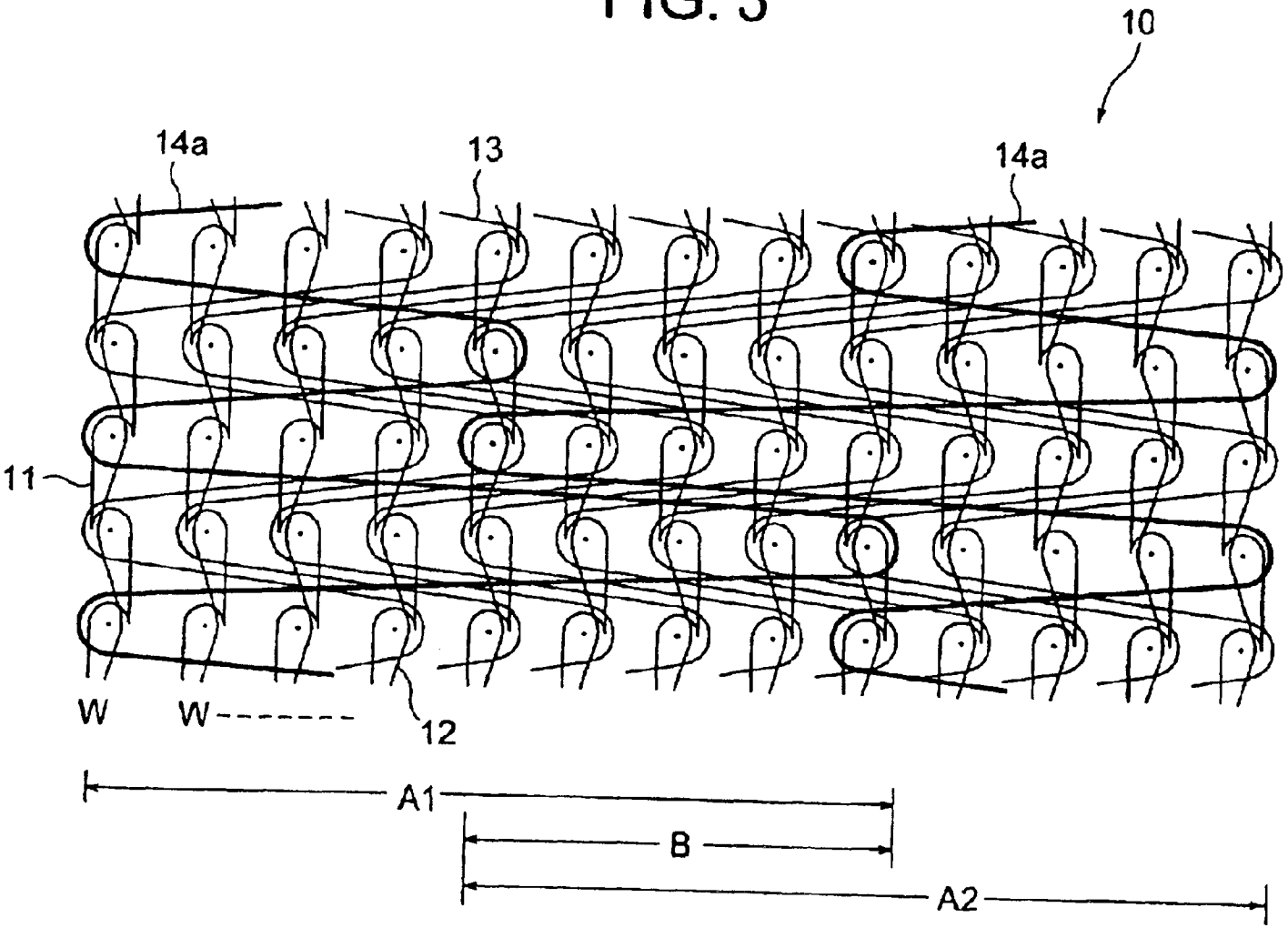
FIG. 3 is a partial plan view showing a structure of a stretchable warp knitted fabric according to a third embodiment of the invention.

FIG. 3 shows a knitting structure of a part of a stretchable warp knitted fabric according to a third embodiment of the invention. A basic structure of the stretchable warp knitted fabric in this embodiment is similar to that of the first and second embodiments and it comprises: the warp knitting yarns 11 comprising chain knitting yarns; the stretchable warp in-laid yarns 12 which are inserted in a zigzag shape into the knitted loop of the warp knitting yarns 11 in the wale direction; and a large number of first weft in-laid yarns 13 which are entwined with needle loops of the warp knitting yarns 11 and run in the course direction so as to be inserted in sinker loops of the warp knitting yarns 11 between the return ends.

As shown in FIG. 3, a first weft in-laid yarn 14*a* of the plurality of second weft in-laid yarns 14, in a first course, is inserted in 5 warp knitted loops to be returned (0-0/5-5), and in a second course, it is inserted in 9 warp knitted loops to be returned (0-0/9-9), and this repeated in the wale direction. A weft in-laid yarn 14*b* which is adjacent to the first yarn, as shown in the same figure, in the first course, is inserted in 5 warp knitted loops to be returned (8-8/13-13), and in the second course, it I inserted in 9 warp knitted loops to be returned (4-4/13-13), and this is repeated in the wale direction.

That is to say, after the first one 14*a* of the second weft in-laid yarns is inserted in the 9 warp knitted loops in the wale direction and is returned, at the next course, it is inserted in the 5 warp knitted loops and then is returned. This continues in the wale direction. The second one 14*b* of the second weft in-laid yarns runs adjacent to the first of the second weft in-laid yarns 14*a* in the wale direction, and it is inserted so as to be dislocated by a knitted loop of a wale in the wale direction. In addition, in this embodiment, portions of return ends of the plurality of second weft in-laid yarns 14*a*, 14*b* . . . , 14*n* are arranged on the same wale so as to be adjacent, and insertion portions which are inserted into long wale regions A1, A2 . . . , A*n* adjacent in the course direction of the weft in-laid yarns 14*a*, 14*b* . . . , 14*n*, share the same wale region B.

Due to this structure, when the stretchable warp knitted fabric 10 according to the third embodiment is pulled in the longitudinal direction (wale direction), because the plurality of second weft in-laid yarns 14*a*, 14*b* . . . , 14*n* are inserted into predetermined wale regions with divided in the course direction, the fabric 10 does not shrink, as in the case of the above-described first and second embodiments. And at the same time, the return ends of the weft in-laid yarns 14*a*, 14*b* . . . , 14*n* are partially disposed in the same wale, but the insertion portions inserted into the long wale regions A1, A2 . . . , A*n* share the common wale region B between the adjacent courses, so that shrinking in the width direction can be further suppressed and also, the surface of the fabric 10 will be even neater and flatter.

Figure 4:
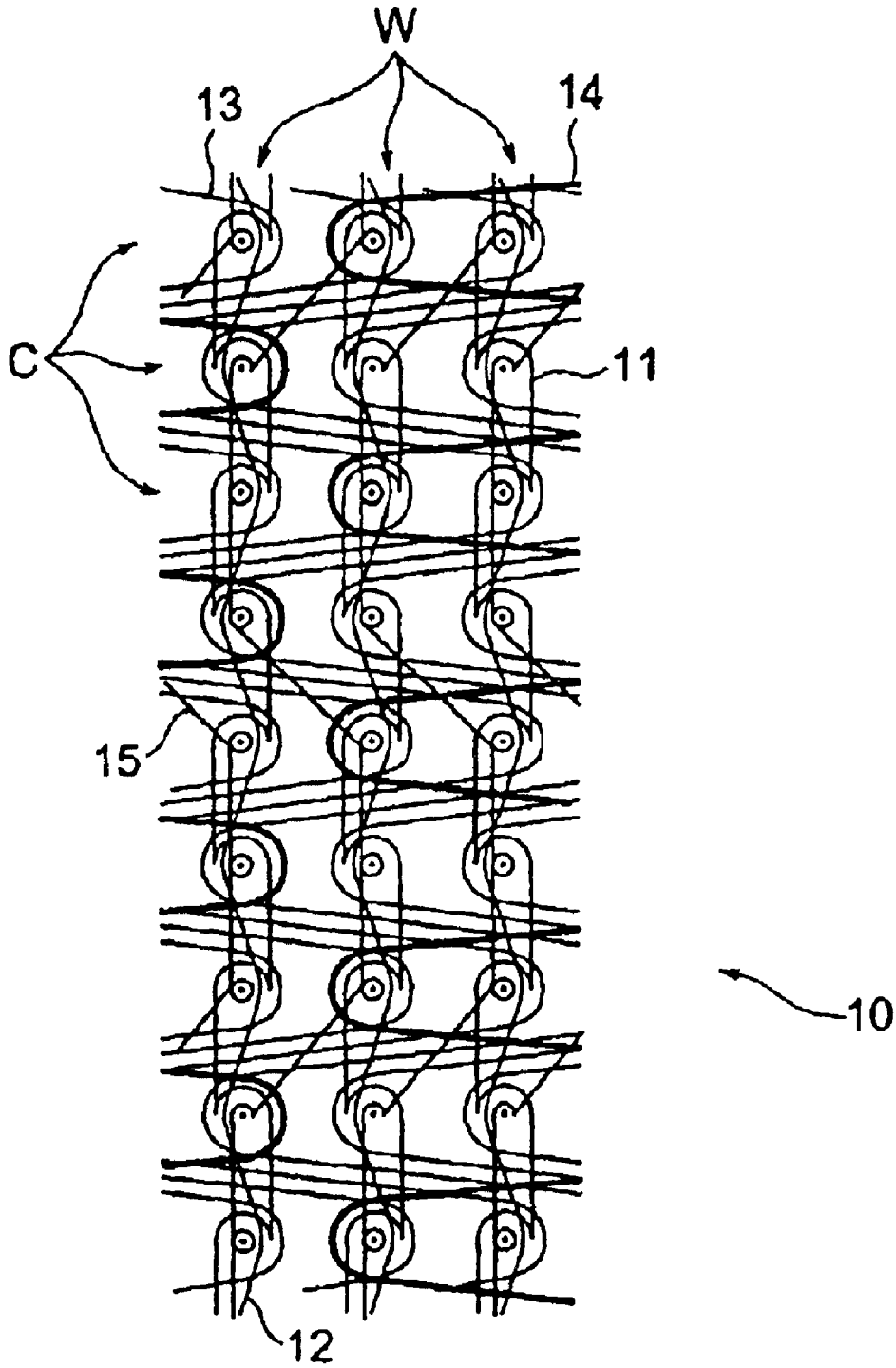
FIG. 4 is a partial plan view of a structure of a stretchable warp knitted fabric according to a fourth embodiment of the invention.

FIG. 4 shows a fourth embodiment of the invention, and shows a knitting structure of a stretchable warp knitted fabric having loops formed on its surface, the loops capable of being used as male and/or female members of a surface fastener. The basic knitting structure is the same as the above-described first embodiment, but this embodiment further includes modified tricot knitting yarns (pile yarns) 15 for use in tulle knits. The modified tricot knitting yarns 15 form chain knitting in 3 courses and then the knitting yarns 15 are entwined with the knitting loops of the adjacent wales W. In addition, a portion of a sinker loop 15*a* of this modified tricot knitting yarn 15 which run diagonally between the course and the wale is projected from a fabric surface in a configuration of a pile.

Regular multifilament or monofilament may be used for this modified tricot knitting yarn 15. In the case where the multifilament is used, it is buffed by a process in the future and a female surface fastener member may be obtained. Also, in the case where the monofilament is used, a hook piece is formed by cutting a portion of the pile and this hook piece is used as a male surface fastener member.

Figure 5:
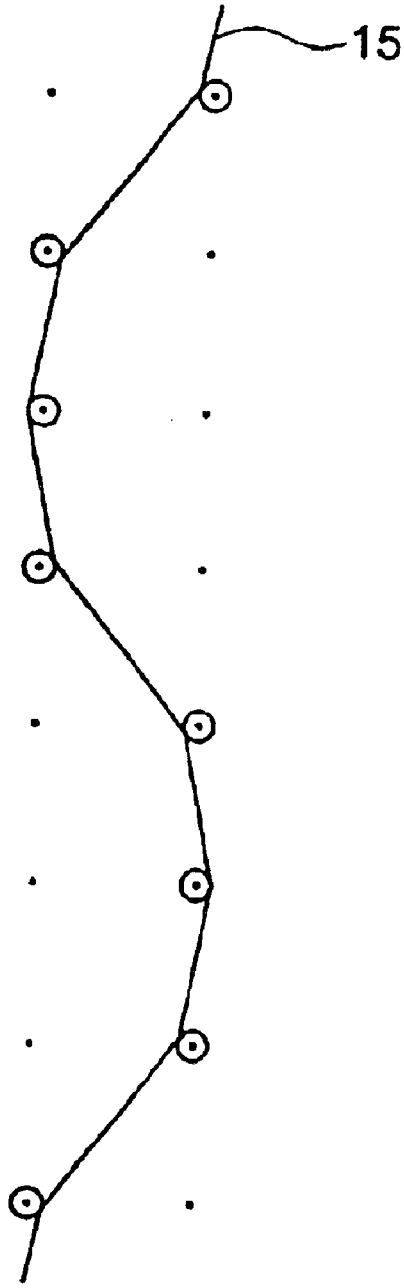
FIG. 5 is a partial plan view showing a structure of a pile knitting yarn according to a modified example of the fourth embodiment of the invention.

FIG. 5 shows another modified structure of the above-mentioned pile yarns 15. In this modified structure, the pile yarn 15 has a structure in which 1-0/1-2/2-1/1-2/1-0/0-1 is repeated, and because the entire knitted loops are formed from closed loops, they are entwined with needle loops of warp chain knitting yarns so as to be pulled and fastened. As a result, the pile yarns 15 are prevented from falling out coming apart with certainty.

Typical embodiments of this invention have been described above, but various modifications may be made thereto, provided they are within the scope defined in the claims. For example, stretchable tricot yarns may be used in addition as the warp knitting yarns, and the structure of the second weft in-laid yarns is not limited to the structures describes above, but rather various modifications are possible.

What is claimed is:

1. A stretchable warp knitted fabric comprising:

warp knitting yarns which form wales;

weft in-laid yarns which run in a course direction; and stretchable warp in-laid yams which run in a wale direction, wherein the weft in-laid yarns comprise first weft in-laid yarns which form a ground weave of the fabric and a plurality of second weft in-laid yarns which consist of at least non-stretchable yarns, and wherein the plurality of the second weft in-laid yarns run sequentially in the course direction on different wale regions of a same course with having an arbitrary length respectively, while crossing the first weft in-laid yarns between courses and wherein the stretchable warn in-laid yarns are inserted in a zigzag shape into knitted loops of each of the warn knitting yarns in the wale direction.

2. A stretchable warp knitted fabric according to claim 1, wherein portions of return ends of the second weft in-laid yarns, which run beside each other and between adjacent courses, are entwined with same knitted loops on a same wale, respectively.

3. A stretchable warp knitted fabric according to claim 1, wherein portions of return ends of the second weft in-laid yarns, which run beside each other and between adjacent courses, are entwined with knitted loops of adjacent wales on adjacent courses, respectively.

4. A stretchable warp knitted fabric according to claim 1, wherein portions of running regions of the second weft in-laid yarns, which run in adjacent courses share a wale region.

5. A stretchable warp knitted fabric according to claim 1, further comprising pile knitting yarns, wherein the pile knitting yarns form pile loops standing on a knitted fabric surface.

6. A stretchable warp knitted fabric according to claim 5, wherein the pile knitting yarns cross over adjacent wales at least every 3 courses and form the pile loops.

* * * * *

UNITED STATES PATENT AND TRADEMARK OFFICE

CERTIFICATE OF CORRECTION

PATENT NO. : 6,848,281 B2 
DATED : February 1, 2005
INVENTOR(S) : Mitsutoshi Ishihara et al.

It is certified that error appears in the above-identified patent and that said Letters Patent is hereby corrected as shown below:

Column 7,
Line 20, "yams" should read -- yarns --.

Column 8,
Lines 3 and 4, "warn" should read -- warp --.

Signed and Sealed this

Seventeenth Day of May, 2005

JON W. DUDAS
*Director of the United States Patent and Trademark Office*